US009663991B2

(12) United States Patent
Zorney et al.

(10) Patent No.: US 9,663,991 B2
(45) Date of Patent: May 30, 2017

(54) LADDER

(75) Inventors: Peter A. Zorney, Plymouth, MI (US); William J. McMaster, Berkeley Heights, NJ (US); Ankur Bhosale, Canton, MI (US)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 14/241,491

(22) PCT Filed: Aug. 24, 2012

(86) PCT No.: PCT/US2012/052217

§ 371 (c)(1),
(2), (4) Date: Feb. 27, 2014

(87) PCT Pub. No.: WO2013/032887

PCT Pub. Date: Mar. 7, 2013

(65) Prior Publication Data

US 2014/0209412 A1 Jul. 31, 2014

Related U.S. Application Data

(60) Provisional application No. 61/528,535, filed on Aug. 29, 2011.

(51) Int. Cl.

| | |
|---|---|
| ***E06C 7/08*** | (2006.01) |
| ***E06C 1/06*** | (2006.01) |
| ***E06C 1/16*** | (2006.01) |

(52) U.S. Cl.

CPC ..... *E06C 7/08* (2013.01); *E06C 1/06* (2013.01); *E06C 1/16* (2013.01); *E06C 7/082* (2013.01)

(58) Field of Classification Search

CPC ..... E06C 7/08; E06C 1/06

(Continued)

(56) References Cited

U.S. PATENT DOCUMENTS

| | | | |
|---|---|---|---|
| 927,491 | A | 7/1909 | Colborne |
| 1,153,558 | A | 9/1915 | Matheny |

(Continued)

FOREIGN PATENT DOCUMENTS

| | | | |
|---|---|---|---|
| CN | 201050290 | Y | 4/2008 |
| EP | 0 327 323 | A1 | 8/1989 |

(Continued)

OTHER PUBLICATIONS

International Search Report for Application No. PCT/US2012/052217 dated Nov. 13, 2012, 2 pages.

(Continued)

*Primary Examiner* — Alvin Chin-Shue
(74) *Attorney, Agent, or Firm* — Christy Spradley

(57) ABSTRACT

A ladder including a first stringer and a second stringer spaced transverse from each other is provided. Each of the first and second stringers defines a channel and includes a plurality of crosspieces disposed in the channels of the first and second stringers. A plurality of rungs are spaced along and coupled between the first and second stringers. Each of the rungs has a horizontal portion and a vertical portion extending from the first stringer to the second stringer. A plurality of ribs are spaced along and coupled between the horizontal and vertical portions of the rungs.

11 Claims, 7 Drawing Sheets

(58) Field of Classification Search
USPC ..... 182/46
See application file for complete search history.

(56) References Cited

U.S. PATENT DOCUMENTS

| | | | | |
|---|---|---|---|---|
| 3,948,192 | A * | 4/1976 | Yellin | A47F 5/10 108/101 |
| 3,997,027 | A | 12/1976 | Patterson et al. | |
| 4,185,649 | A | 1/1980 | Germain | |
| 4,834,216 | A | 5/1989 | Wallick, Jr. et al. | |
| 4,848,515 | A * | 7/1989 | Rinke | E04F 11/002 182/106 |
| 4,997,061 | A * | 3/1991 | Aymes | E04H 4/144 182/106 |
| 5,646,754 | A | 7/1997 | Takeda et al. | |
| 6,422,344 | B1 | 7/2002 | Cox | |
| 6,874,598 | B1 | 4/2005 | Baker | |
| 2003/0079941 | A1 | 5/2003 | Pettit | |
| 2006/0196999 | A1 * | 9/2006 | Owens | E06C 7/143 248/210 |
| 2009/0000867 | A1 * | 1/2009 | Wang | E06C 1/39 182/104 |

FOREIGN PATENT DOCUMENTS

| | | | |
|---|---|---|---|
| EP | 0 462 946 | A1 | 12/1991 |
| JP | S 54-096410 | A | 7/1979 |
| JP | S 57-078340 | A | 5/1982 |
| JP | H 05-060687 | A | 3/1993 |
| JP | 3136052 | B2 | 2/2001 |
| WO | WO 2011/003403 | A2 | 1/2011 |

OTHER PUBLICATIONS

BASF, The Chemical Company, Ultramid®HMG14 HS BK-102 Polyamide 66 Data Sheet, Mar. 2011, 2 pages.
BASF, The Chemical Company, Ultramid®B3EG10 Polyamide 6 Data Sheet, Mar. 2011, 2 pages.
BASF, The Chemical Company, Ultramid®B3EG7 Polyamide 6 Data Sheet, Mar. 2011, 2 pages.
English language abstract and machine-assisted English translation for WO 2011/003403 extracted from espacenet.com database on Jun. 10, 2015, 33 pages.
English language abstract not found for JPS 54-096410; however, see English language equivalent U.S. Pat. No. 4,185,649. Original document extracted from espacenet.com database on Sep. 20, 2016, 6 pages.
English language abstract and machine-assisted English translation for JPS 57-078340 extracted from PAJ database on Sep. 20, 2016, 3 pages.
English language abstract and machine-assisted English translation for JPH 05-060687 extracted from espacenet.com database on Sep. 20, 2016, 9 pages.
English language abstract for JP 3136052 extracted from espacenet.com database on Sep. 20, 2016, 2 pages.
English language abstract for CN 201050290 extracted from espacenet.com database on Mar. 16, 2015, 1 page.

* cited by examiner

LADDER

RELATED APPLICATIONS

This application is the National Stage of International Patent Application No. PCT/US2012/052217, filed on Aug. 24, 2012, which claims priority to and all the advantages of U.S. Provisional Patent Application No. 61/528,535, filed on Aug. 29, 2011, the content of which is incorporated herein by reference.

BACKGROUND OF THE INVENTION

1. Field of the Invention

The subject invention generally relates to a ladder having excellent strength, rigidity, and weight.

2. Description of the Related Art

Generally, ladders, including fixed ladders, step ladders, step stools, and extension ladders, are formed from metals or combinations of metals and fiberglass. Metals and/or fiberglass are generally known to have excellent strength. However, even ladders formed from these materials may lack structural features which impart the ladder with sufficient strength and rigidity for use. Ladders formed from metals or combinations of metals and fiberglass can also be heavy and therefore difficult to manipulate and use. Additionally, ladders formed from metals generally require a significant amount of linkages, such as rivets or spot welding, therefore substantially increasing production time and cost of these ladders. Use of metals in ladders is further prohibitive in view of the increased cost of metals, such as aluminum and steel. One alternative material to metal which may be used to form ladders is thermoplastics.

While thermoplastics are often cheaper than metals, thermoplastics are not generally known for possessing those physical properties typical of metals, e.g. excellent strength and rigidity, which are required to form a safe, sturdy, and useful ladder. Accordingly, ladders formed from thermoplastics generally require more material than ladders formed from metals to impart the thermoplastic ladders with sufficient strength and rigidity, resulting in thermoplastic ladders that are generally heavier and therefore more difficult to operate than ladders formed from metals. One method to improve the strength of thermoplastics, and to reduce overall weight of ladders formed therefrom, is to include reinforcing fibers, such as glass fibers (fiberglass). Although thermoplastics reinforced with fiberglass have increased strength, ladders formed from these materials are still typically heavy and are therefore difficult to manipulate and operate.

Despite efforts using different materials such as metals, thermoplastics, or thermoplastics including reinforcing fibers to form ladders, concerns remain regarding the strength, rigidity, and weight of these ladders. Accordingly, there remains an opportunity to form an improved ladder.

SUMMARY OF THE INVENTION AND ADVANTAGES

A ladder includes a first stringer and a second stringer spaced transverse from the first stringer. The first and second stringers each define a channel and include a plurality of crosspieces disposed in the channels of the first and second stringers. A plurality of rungs are spaced along and coupled between the first and second stringers with each of the rungs including a horizontal portion and a vertical portion extending from the first stringer to the second stringer. The horizontal portion has a top surface and a bottom surface spaced from and opposite the top surface. The vertical portion extends generally perpendicularly away from the bottom surface of the horizontal portion and has a front surface and a rear surface spaced from and opposite the front surface. A plurality of ribs are spaced along and coupled between the horizontal and vertical portions of the rungs. The ribs extend from the bottom surface of the horizontal portion to at least one of the front and rear surfaces of the vertical portion.

The subject invention improves the strength and rigidity of the ladder by including the plurality of rungs having the horizontal and vertical portions with the plurality of ribs extending between the bottom surface of the horizontal portion to at least one of the front and rear surfaces of the vertical portion. The plurality of rungs including the plurality of ribs more efficiently spreads applied force and does so in a manner requiring less material, thereby minimizing weight of the ladder and improving ease of operation.

BRIEF DESCRIPTION OF THE DRAWINGS

Other advantages of the present invention will be readily appreciated, as the same becomes better understood by reference to the following detailed description when considered in connection with the accompanying drawings.

FIG. 9 is a cross sectional view of the rung taken along line 9-9 of FIG. 3.

DETAILED DESCRIPTION OF THE INVENTION

Referring to the Figures, wherein like numerals indicate corresponding parts throughout the several views, a ladder is shown generally at 20. The ladder 20 including the various embodiments described in greater detail below is suitable for use as a fixed ladder or as a step ladder. However, it should be understood that the ladder 20 is not limited to only those applications.

Figure 1:
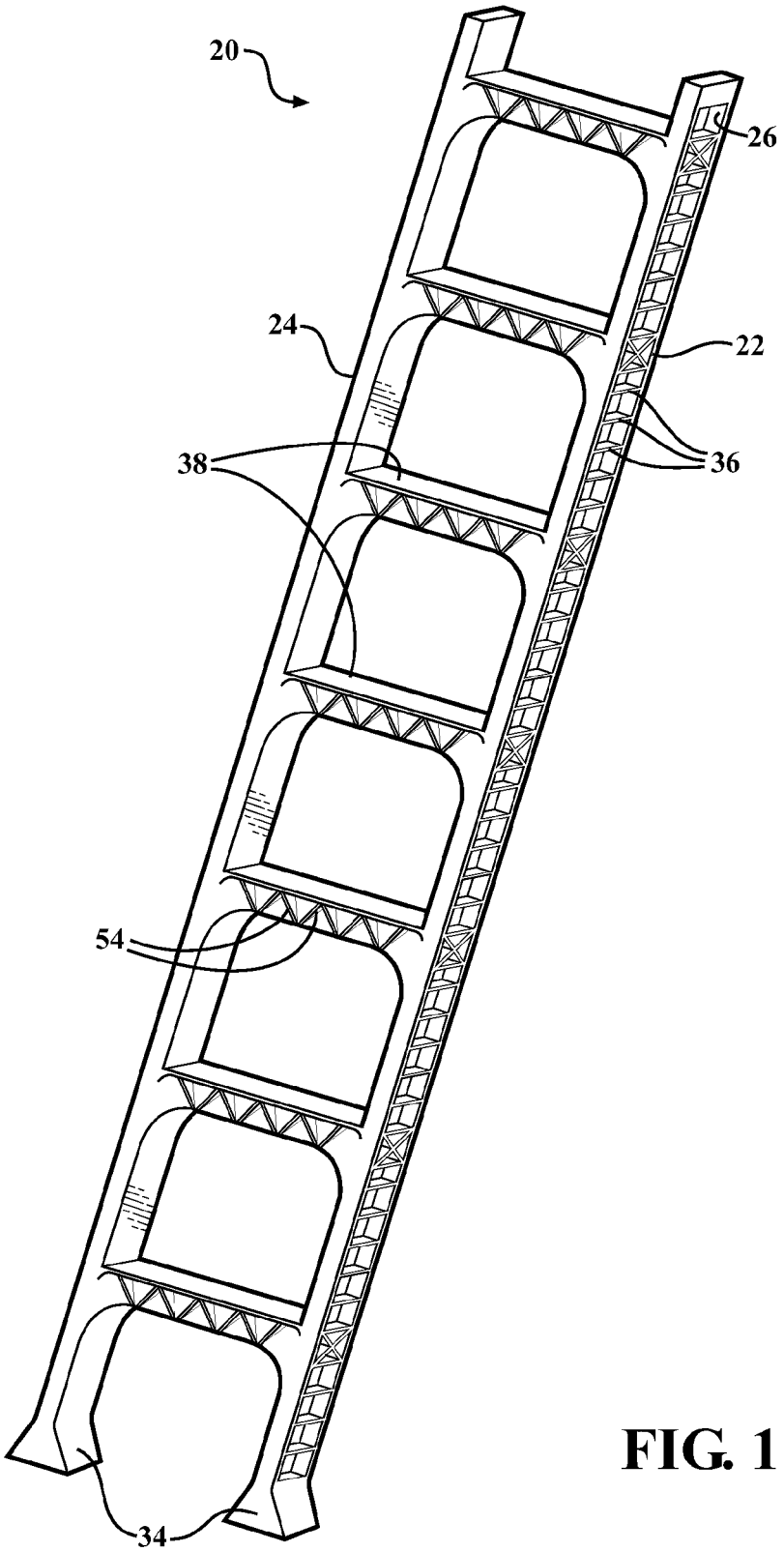
FIG. 1 is a perspective view of a ladder.
Figure 2:
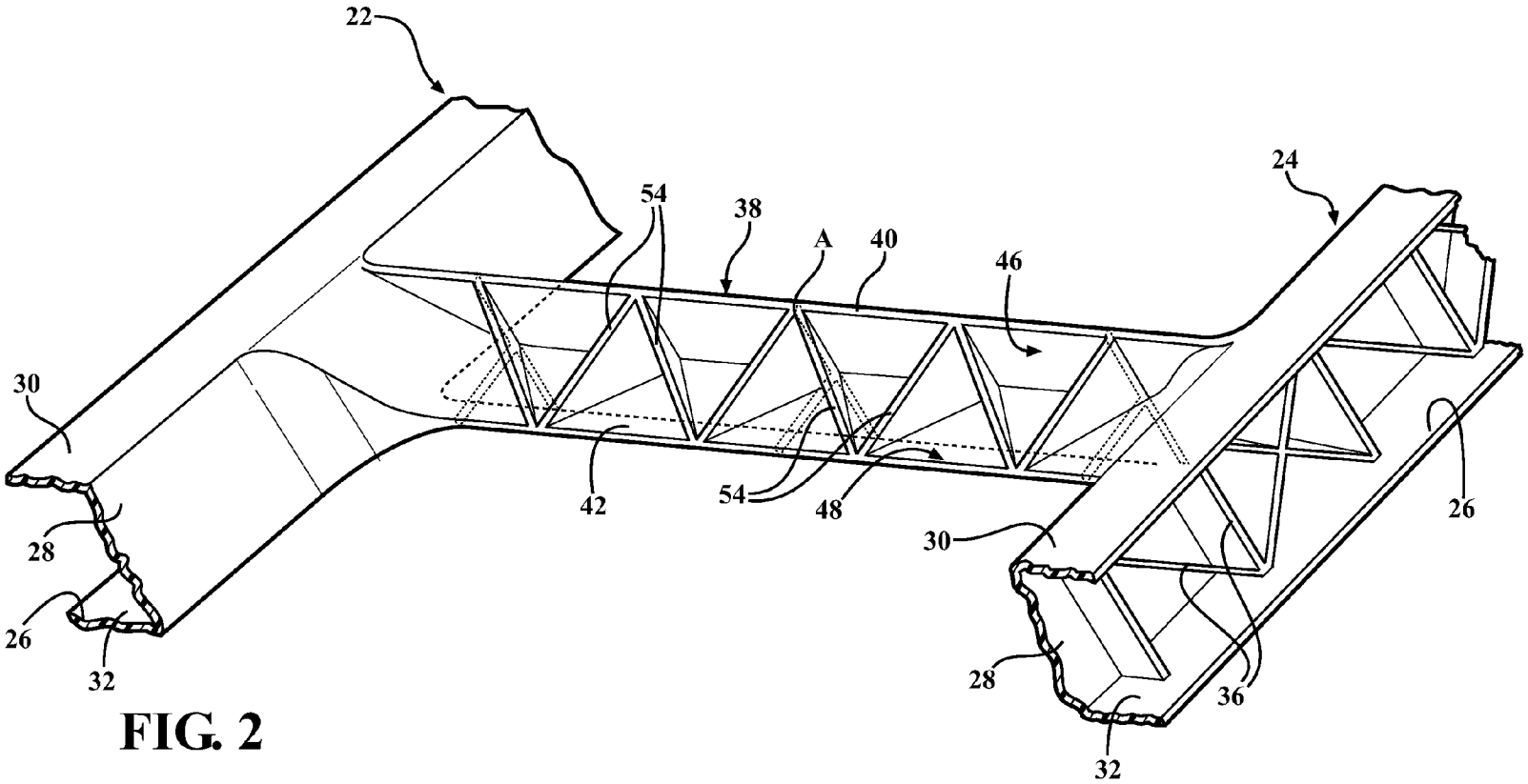
FIG. 2 is a partial perspective view of the ladder.

The ladder 20 comprises a first stringer 22 and a second stringer 24 typically spaced transverse from each other. Typically, the first and second stringers 22, 24 are parallel to and mirror images of one another. Additionally, each of said first and second stringers 22, 24 typically defines a channel 26. In one embodiment, each of the first and second stringers 22, 24 has a substantially C-shape cross-section that defines the channel 26. In this embodiment, the first and second stringers 22, 24 each have a base wall 28, a first wall 30, and a second wall 32 spaced transverse from the first wall 30. Typically, the first and second walls 30, 32 are generally parallel to one another and extend generally perpendicularly away from the base wall 28 giving the first and second stringers 22, 24 the substantially C-shape cross-section that defines the channel 26 as described above and as best shown in FIGS. 1 and 2. In this embodiment, the first and second walls 30, 32 of each of the first and second stringers 22, 24 may extend towards one another or extend away from one another. Typically, the first walls 30 and second walls 32 of each of the first and second stringers 22, 24, extend away from one another as best shown in FIGS. 1 and 2. This embodiment provides the ladder 20 with excellent strength and rigidity while incorporating less material than other configurations therefore also reducing the overall weight of the ladder.

In another embodiment, the first and second stringers 22, 24 individually terminate in a foot 34 having a tapered configuration as best shown in FIG. 1. The foot 34 contacts the ground when the ladder 20 is in operation and increases stability and ease of use of the ladder 20 by providing additional surface area for contact between the ladder 20 and the ground.

A plurality of crosspieces 36 is disposed in the channels 26 of the first and second stringers 22, 24 to further increase strength and rigidity of the ladder 20, as best shown in FIGS. 1 and 2. The crosspieces 36 may be disposed in the channels 26 in any manner to improve rigidity of the first and second stringers 22, 24. In one embodiment, the crosspieces 36 extend from the first walls 30 to the second walls 32 at various angles across each of the channels 26 of the first and second stringers 22, 24 respectively. In another embodiment, the crosspieces 36 extend horizontally from the first walls 30 to the second walls 32 of the first and second stringers 22, 24 and are generally perpendicular to the first and second walls 30, 32 as best shown in FIG. 1. This configuration further provides the ladder 20 with excellent strength and rigidity with the least increase in overall weight, particularly when incorporated in combination with the embodiment described above wherein the first walls 30, the second walls 32, and the channels 26 of each of the first and second stringers 22, 24 face away from one another. In another embodiment, at least two of the crosspieces 36 intersect in the channels 26 opposite where the first and second stringers 22, 24 contact each of a plurality of rungs 38, described in greater detail below, to define a substantially X-shape as best shown in FIGS. 1 and 2.

The ladder 20 also includes the plurality of rungs 38 spaced along and coupled between the first and second stringers 22, 24. In one embodiment, the rungs 38 are coupled between the first and second stringers 22, 24 between the channels 26 defined by the first and second stringers 22, 24. In another embodiment, the rungs 38 are coupled between the first and second stringers 22, 24 opposite from the channels 26 defined by the first and second stringers 22, 24 as best shown in FIG. 1.

Figure 10:
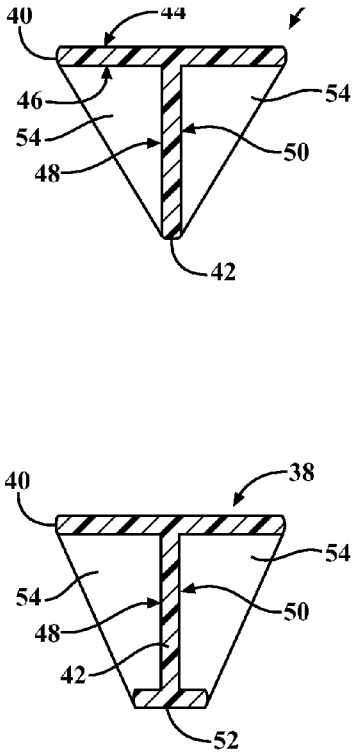
FIG. 10 is a cross sectional view of the rung taken along line 10-10 of FIG. 6.

Each of the rungs 38 includes a horizontal portion 40 and a vertical portion 42. Typically, each of the horizontal and vertical portions 40, 42 extends from the first stringer 22 to the second stringer 24. In one embodiment, the vertical portion 42 of the rungs 38 flares out as the vertical portions 42 contact each of the first and second stringers 22, 24 as best shown in FIGS. 1 and 2. Typically, the horizontal portion 40 has a top surface 44 and a bottom surface 46 spaced from and opposite the top surface 44. The vertical portion 42 typically extends generally perpendicularly away from the bottom surface 46 of the horizontal portion 40. In one embodiment, the vertical portion 42 substantially bisects the horizontal portion 40 as best shown in FIGS. 9 and 10. However, it should be appreciated that the vertical portion 42 may also extend generally perpendicularly away from the bottom surface 46 of the horizontal portion 40 in any manner. Typically, the vertical portion 42 has a front surface 48 and a rear surface 50 spaced from and opposite the front surface 48. In one embodiment, the vertical portion 42 terminates in a flange 52 opposite and substantially parallel to the horizontal portion 40 with the flange 52 extending from the first stringer 22 to the second stringer 24 as best shown in FIGS. 6, 7, 8, and 10. The flange 52 provides additional support to a plurality of ribs 54, described in greater detail below, therefore increasing strength and rigidity of ladder 20.

The ribs 54 are spaced along and coupled between the horizontal and vertical portions 40, 42 of the rungs 38 as best shown in FIG. 2. Typically, the ribs 54 extend from the bottom surface 46 of the horizontal portion 40 to at least one of the front and rear surfaces 48, 50 of the vertical portion 42. In a first embodiment, the ribs 54 are perpendicular to the bottom surface 46 of the horizontal portion 40 and therefore to at least one of the front and rear surfaces 48, 50 of the vertical portion 42, and the flange 52 if present. In a second embodiment, the ribs 54 include at least one first pair of ribs extending from the bottom surface 46 of the horizontal portion 40 to the front surface 48 of the vertical portion 42 and intersect at a first point of intersection A to define a substantially V-shape. In this embodiment, the at least one first pair of ribs intersects at the first point of intersection A at any angle $\alpha$, alternatively the angle $\alpha$ is from 10 to 120, alternatively from 30 to 90, and alternatively from 45 to 90, degrees. In a third embodiment, the ribs 54 include both the at least one first pair of ribs intersecting at the first point of intersection A to define a substantially V-shape and ribs 54 that are perpendicular to the bottom surface 46 of the horizontal portion 40.

Figure 3:
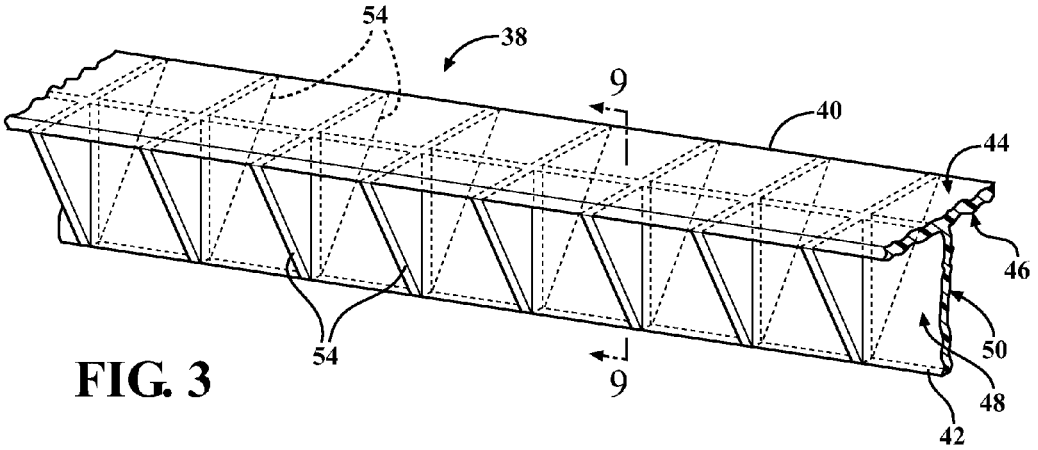
FIG. 3 is a partial perspective view of an embodiment of a rung of the ladder.
Figure 4:
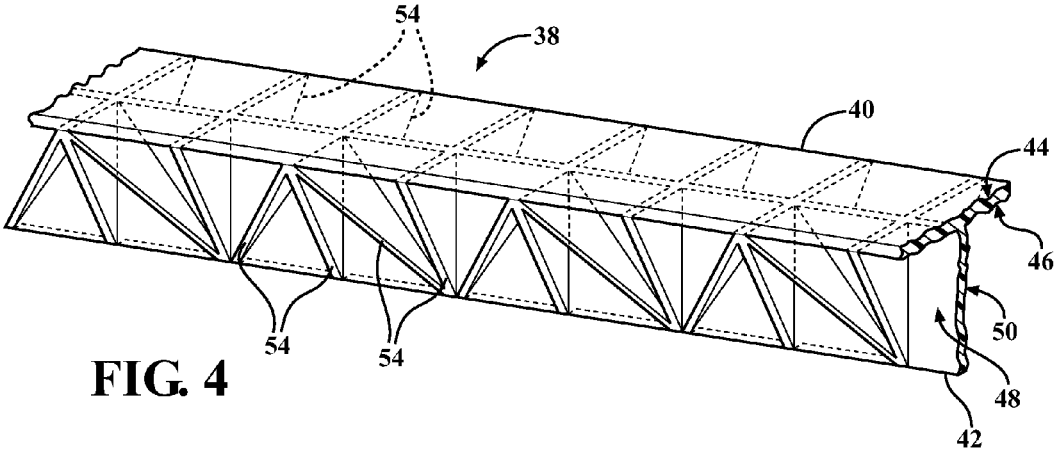
FIG. 4 is a partial perspective view of another embodiment of a rung of the ladder.
Figure 5:
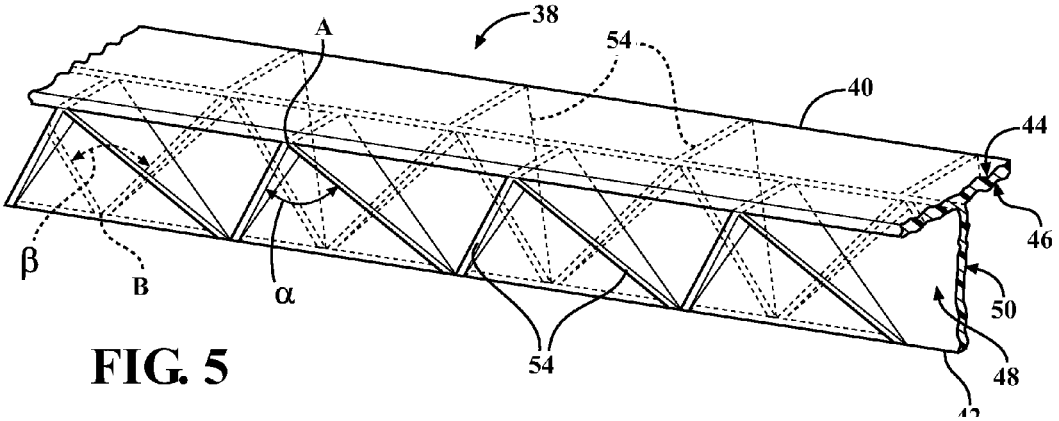
FIG. 5 is a partial perspective view of another embodiment of a rung of the ladder.
Figure 6:
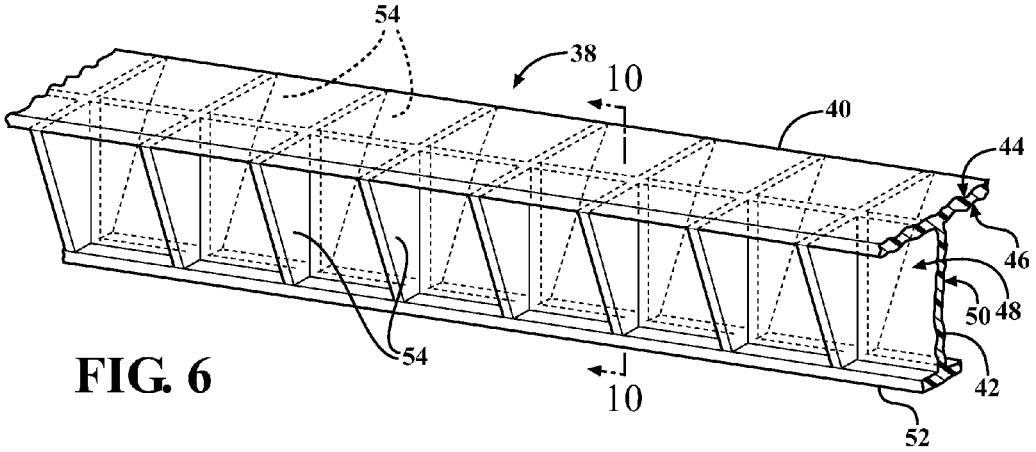
FIG. 6 is a partial perspective view of another embodiment of a rung of the ladder.

In another embodiment, the ribs 54 includes a first set of ribs and a second set of ribs spaced and opposite the first set of ribs as best shown in FIGS. 3-10. Typically, the first set of ribs extends from the bottom surface 46 of the horizontal portion 40 to the front surface 48 of the vertical portion 42 and the flange 52 if present. The second set of ribs typically extends from the bottom surface 46 of the horizontal portion 40 to the rear surface 50 of the vertical portion 42 and the flange 52 if present. In a first embodiment, the first set of ribs is generally perpendicular to the bottom surface 46 of the horizontal portion 40 and therefore to the front surface 48 of the vertical portion 42, and the flange 52, if present, as best shown in FIGS. 3 and 6. In this embodiment, the second set of ribs is generally perpendicular to the bottom surface 46 of the horizontal portion 40 and therefore to the rear surface 50 of the vertical portion 42, and the flange 52, if present.

Figure 8:
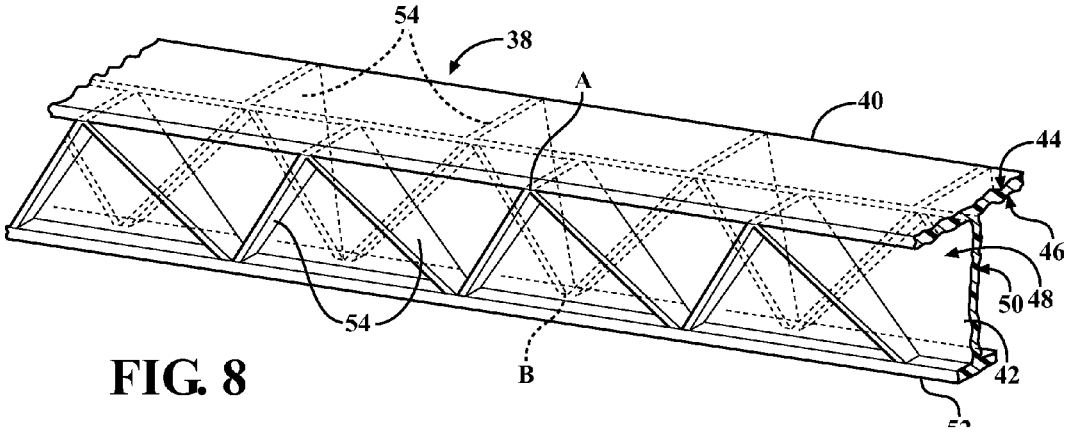
FIG. 8 is a partial perspective view of another embodiment of a rung of the ladder.

In second embodiment, the first set of ribs includes at least one first pair of ribs intersecting at a first point of intersection A to define a substantially V-shape and the second set of ribs includes at least one second pair of ribs intersecting at a second point of intersection B to define a substantially inverted V-shape as best shown in FIGS. 5 and 8. In this embodiment, the second pair of ribs typically intersects at the second point of intersection B at any angle $\beta$, alternatively the angle $\beta$ is from 10 to 120, alternatively from 30 to 90, and alternatively from 45 to 90, degrees. Typically, the angle β is equal to the angle α. However, it should be appreciated that the angle α and the angle β may be different. Typically, the second point of intersection B is aligned horizontally with and spaced vertically from the first point of intersection A of the first and second pair of ribs.

Figure 7:
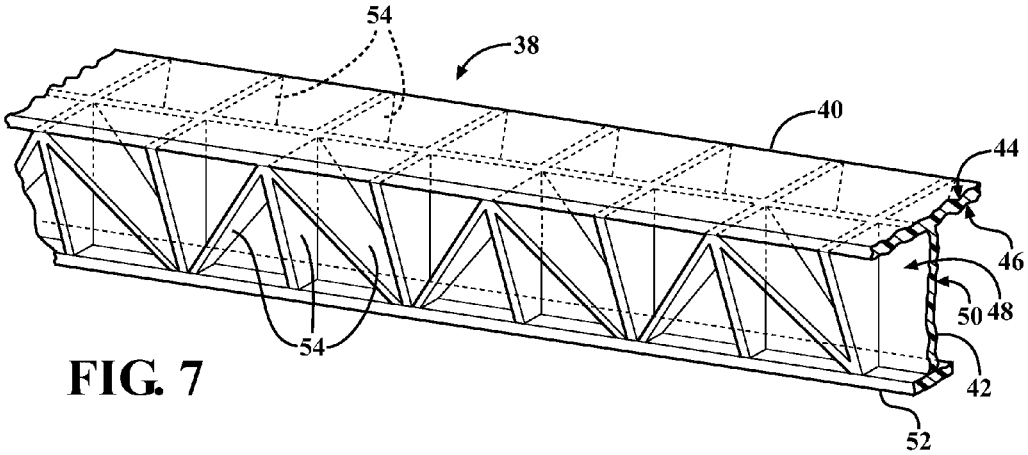
FIG. 7 is a partial perspective view of another embodiment of a rung of the ladder.

In third embodiment, the first set of ribs includes the at least one first pair of ribs intersecting at the first point of intersection A to define a substantially V-shape and ribs 54 that are perpendicular to the bottom surface 46 of the horizontal portion 40 and therefore to the front surface 48 of the vertical portion 42, and the flange 52, if present, as best shown in FIGS. 4 and 7. Additionally, the second set of ribs includes the at least one second pair of ribs intersecting at the second point of intersection B to define a substantially inverted V-shape and ribs 54 that are perpendicular to the bottom surface 46 of the horizontal portion 40 and therefore to the rear surface 50 of the vertical portion 42, and the flange 52, if present.

The ribs 54 provide the ladder 20, and more specifically the rungs 38, with excellent strength and rigidity. Accordingly, less material is required to imbue the ladder 20 with these physical properties than conventional ladders, contributing to the ladder 20 having excellent overall weight and ease of use.

Figure 11:
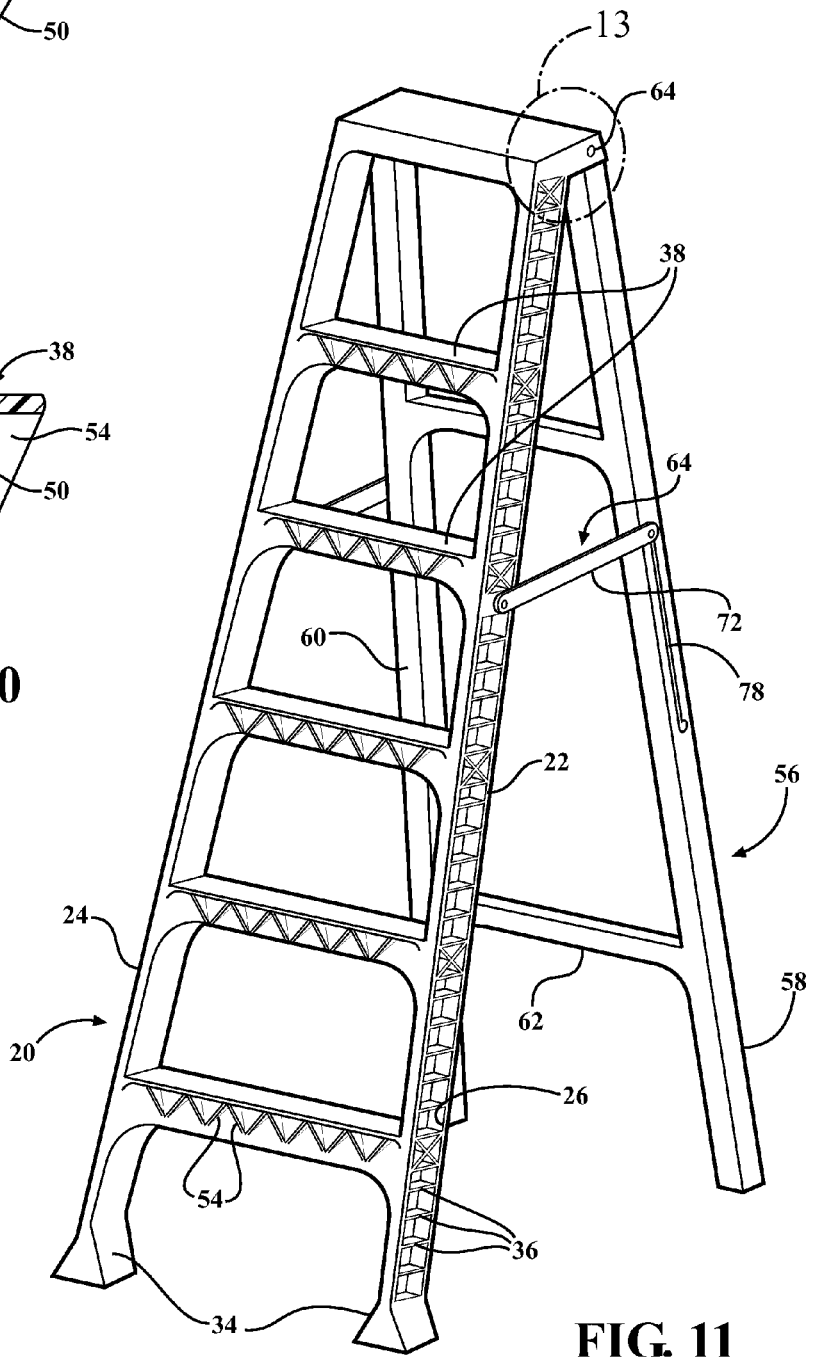
FIG. 11 is a perspective view of another embodiment of the ladder including a support.
Figure 12:
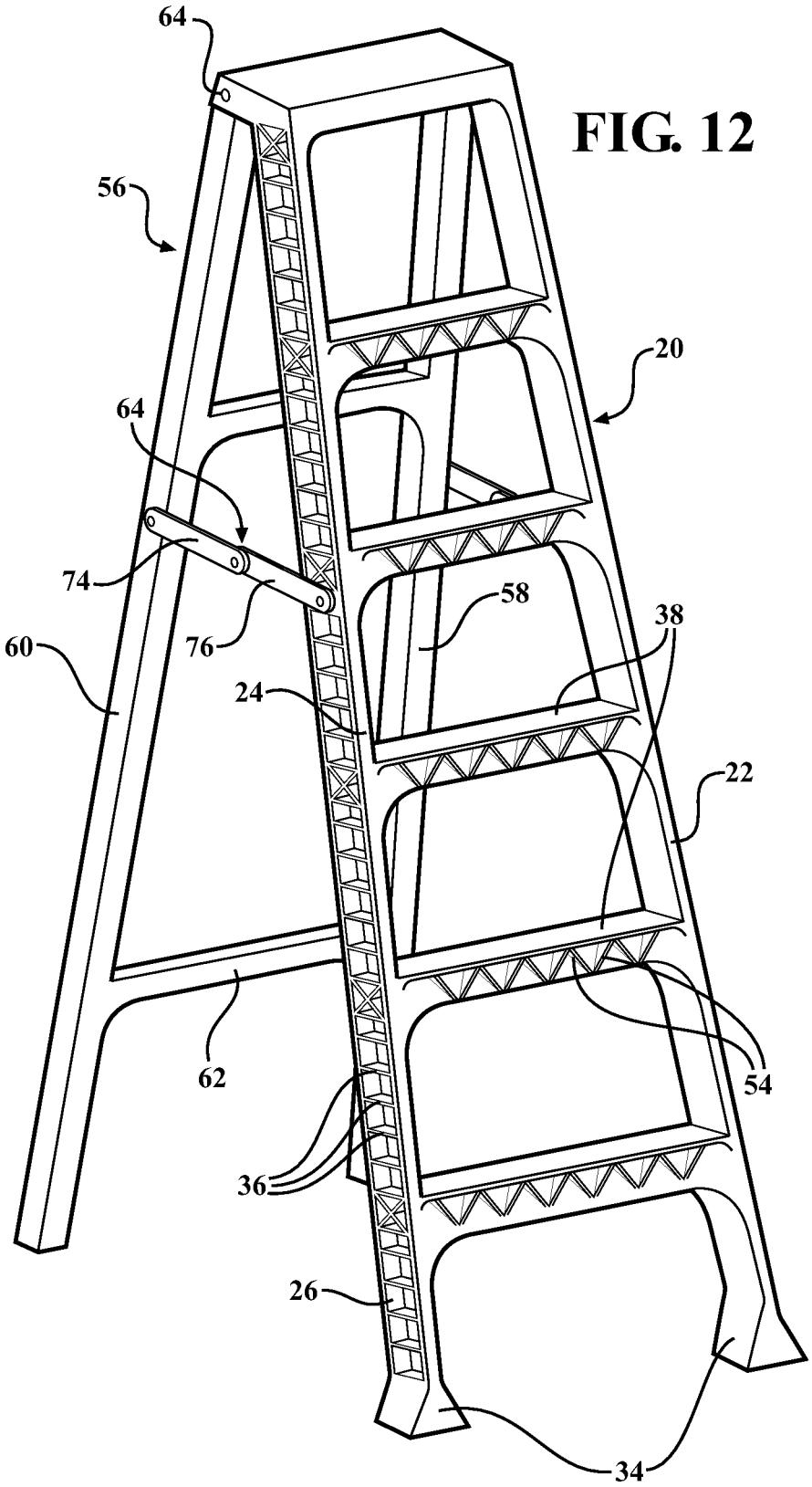
FIG. 12 is a perspective view of yet another embodiment of the ladder including the support.
Figure 13:
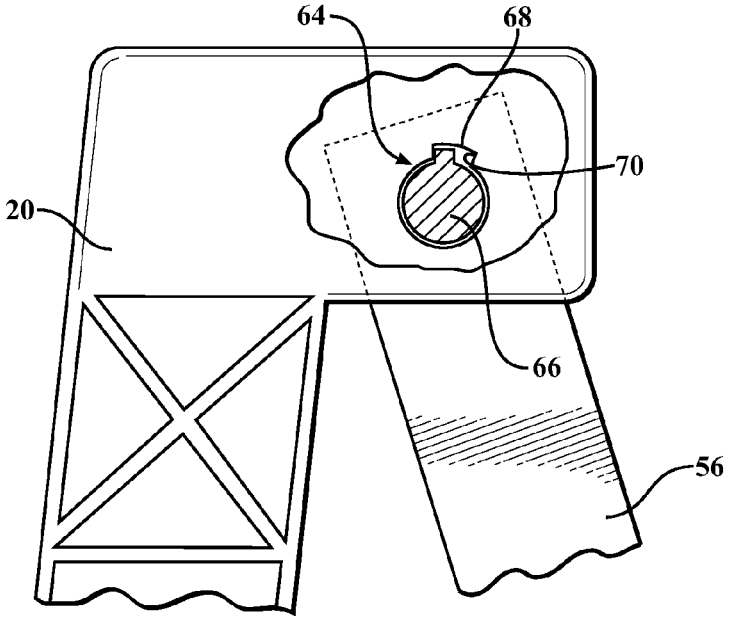
FIG. 13 is a partial cutaway view taken from FIG. 11 illustrating a linkage coupling the ladder and the support in an open position.
Figure 14:
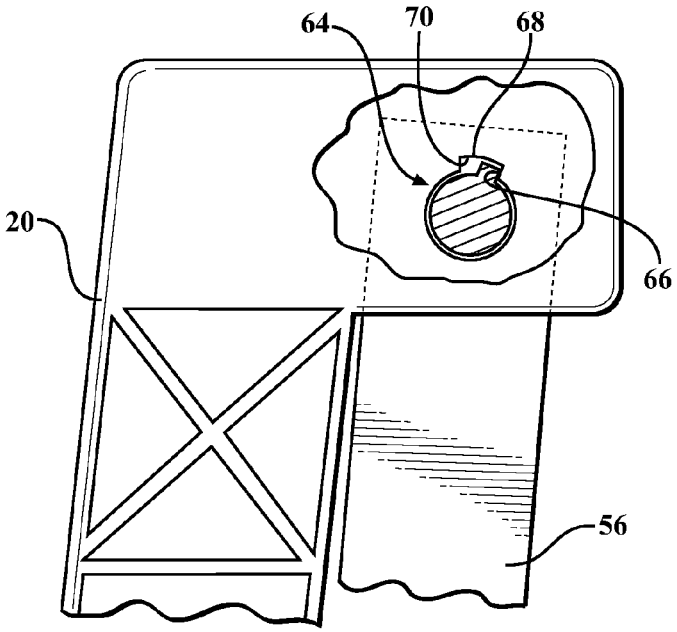
FIG. 14 is a partial cutaway view illustrating a linkage coupling the ladder and the support in a closed position.

In one embodiment, the ladder 20 further includes a support 56 as best shown in FIGS. 11 and 12. The support 56 has a first rail 58 and a second rail 60 transversely spaced from the first rail 58. The support 56 also includes a plurality of braces 62 spaced along and coupled between the first and second rails 58, 60. In this embodiment, at least one linkage 64 couples the ladder 20 and the support 56. The at least one linkage 64 pivotally couples the ladder 20 and the support 56. In one embodiment, the linkage 64 includes a pin and socket joint comprising a pin 66 and a socket 68 defining a void 70 for receiving said pin 66 as best shown in FIGS. 13 and 14. In another embodiment, the linkage 64 includes a bracket 72 having a first end coupled to the ladder 20 and a second end coupled to the support 56 as best shown in FIG. 11. In this embodiment, the support 56 defines a linking channel 78 for receiving the second end of bracket 72. More specifically, the bracket 72 may slide from an unlocked position to a locked position as required by users. In another embodiment, the linkage 64 includes a first piece 74 coupled to the ladder 20 and to a second piece 74 that is coupled to the support 56 as best shown in FIG. 12. In this embodiment the first and second pieces 72, 74 rotate in relation to the ladder 20 and support 56 respectively, from an unlocked position to a locked position as required by users.

The ladder 20, and the support 56 if present, may comprise any material. Typically, the ladder 20, and the support 56 if present, comprises a polymeric material. Suitable examples of polymeric materials include, but are not limited to thermoplastic and thermosetting polymers. One particularly suitable polymeric material is a polyamide. Examples of suitable polyamides include, but are not limited to, nylon 6 and nylon 6/6. In one embodiment, the polymeric material includes nylon 6 only, alternatively nylon 6/6 only, and alternatively various blends of nylon 6 and nylon 6/6. However, it should be appreciated that polymeric materials other than nylon may be used to manufacture the ladder 20. In another embodiment, the polymeric material includes additives to improve physical properties of the polymeric material.

Suitable additives include, but are not limited to, non-fiber impact modifiers, fiber-based impact resistance additives, coupling agents, pigments, glass or carbon fibers, mineral or glass beads, stabilizers, and combinations thereof. Although not required, the polymeric material is typically filled with fibers in an amount of from 20% to 75% by weight, alternatively from 30% to 65% by weight, alternatively from 35% to 60% by weight, alternatively from 35% to 50% by weight, alternatively from 50% to 60% by weight, alternatively from 30% to 40% by weight, alternatively from 45% to 55% by weight, and alternatively from 55% to 65% by weight, based on a combined total weight of the polymeric material and the fibers. The fibers improve the impact resistance with or without the non-fiber impact modifiers referenced above. Typically, the fibers are glass fibers; however it should be appreciated that the fibers may include other material or other materials in combination with glass. The fibers may vary in size (e.g. length, diameter, etc.) and may be coated or uncoated. For example, in one embodiment, it is preferred that the fibers have an average diameter of less than 20, alternatively from 5 to 20, alternatively from 6 to 16, alternatively from 10 to 15, alternatively 10, and alternatively 13, microns. The polymeric material or the fibers may each include other components to encourage bonding between the polymeric material and the fibers. Suitable examples of commercially available polymeric materials having fibers include, but are not limited to Ultramid®, Ultradur®, and Ultrafoam® polyamides commercially available from BASF Corp. In one embodiment, the polymeric material includes at least one of Ultramid® B3EG7, PA6, 35% glass filled by weight; Ultramid® B3EG10, PA6, 50% glass filled by weight; and Ultramid® HMG14 HS BK-102, PA66, 60% glass filled by weight.

Typically the polymeric material has a tensile modulus of from 6,000 to 22,000, alternatively from 7,000 to 21,000, alternatively from 6,000 to 8,000, alternatively from 10,000 to 12,000, alternatively from 18,000 to 22,000, and alternatively from 19,000 to 21,000, MPa when tested in accordance with ISO 527-1/-2 at 23° C. The polymeric material typically has a tensile stress at break of from 50 to 500, alternatively from 100 to 400, alternatively from 200 to 300, alternatively from 200 to 250, alternatively from 18,000 to 22,000, and alternatively from 19,000 to 21,000, MPa when tested in accordance with ISO 527-1/-2 at 23° C. Typically, the polymeric material has a tensile strain at break of from 1 to 5, alternatively from 2 to 4, and alternatively from 2.5 to 3.5, % when tested in accordance with ISO 527-1/-2 at 23° C. The polymeric material typically has a flexural strength of from 100 to 500, alternatively from 200 to 500, alternatively from 300 to 500, alternatively from 300 to 400, and alternatively from 350 to 400, MPa when tested in accordance with ISO 178 at 23° C. Typically the polymeric material has a flexural modulus of from 9,000 to 20,000, alternatively from 10,000 to 19,000, alternatively from 9,000 to 11,000, alternatively from 14,000 to 16,000, alternatively from 17,000 to 21,000, and alternatively from 18,000 to 20,000, MPa when tested in accordance with ISO 178 at 23° C. The polymeric material typically has a Charpy notched toughness of from 5 to 35, alternatively from 10 to 30, and alternatively from 12 to 25, $kJ/m^2$ when tested in accordance with ISO 179/1EA at 23° C. and a Charpy notched toughness of from 5 to 25, alternatively from 10 to 20, and alternatively from 11 to 17, $kJ/m^2$ when tested in accordance with ISO 179/1EA at −30° C. Typically, the polymeric material has a Charpy unnotched toughness of from 80 to 120, alternatively from 90 to 110, and alternatively from 95 to 105, $kJ/m^2$ when tested in accordance with ISO 179/1EA at 23° C. and a Charpy notched toughness of from 70 to 110, alternatively from 80 to 105, and alternatively from 85 to 101, $kJ/m^2$ when tested in accordance with ISO 179/1EA at −30° C. Typically the polymeric material retains the physical properties described above even after moisture conditioning.

The ladder 20 may be manufactured/formed using any method. Typically, the ladder 20 is formed via melt processing. Suitable examples of melt processing include, but are not limited to, injection molding, extrusion, compression molding, and vacuum forming. Typically, the ladder is formed via injection molding. Referring to the embodiment of the ladder 20 further including the support 56, both the ladder 20 and the support are typically formed via injection molding.

Typically, the ladder 20 is monolithic. Stated differently, the first and second stringers 22, 24, the crosspieces 36, the rungs 38, and the ribs 54 of the ladder 20 are integrally formed together as a single unit without joints or linkages. Referring to the embodiment of the ladder 20 further including the support 56, both the ladder 20 and the support are typically monolithic. In this embodiment, at least one linkage 64 is present for pivotally coupling the ladder 20 and the support 56. However, it should be appreciated that the ladder 20 may include additional joints or linkages.

In another embodiment, the ladder 20 is subjected to additional processing steps after formation. In one embodiment, the ladder 20 is "cored out", i.e., material is removed from the ladder 20 after formation. For example, in this embodiment, a portion of the first and second stringers 22, 24 and the rungs 38 may be cored out where the rungs 38 contact the first and second stringers 22, 24. In the example above, the crosspieces 36 disposed in the channels 26 of the first and second stringers 22, 24 opposite the rungs 38, will extend through the cored out areas of the first and second stringers 22, 24 into the cored out area of and contacting the rungs 38 as best shown in FIG. 2. This additional processing step further reduces the overall weight of the ladder 20 without reducing the strength and rigidity of the ladder 20. However, it should be understood that the ladder 20 may be manufactured/formed to achieve that which is described in the Example above.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

It is also to be understood that any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The present invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, the present invention may be practiced otherwise than as specifically described.

What is claimed is:

1. A plastic ladder comprising:

a first stringer and a second stringer spaced laterally from each other, with each of said first and second stringers having a closed inner lateral surface and an open outer lateral surface defining a channel;

a plurality of crosspieces disposed and extending longitudinally in said channels of said first and second stringers for rigidity;

a plurality of rungs spaced along and coupled between said first and second stringers, said first and second stringers, said cross-pieces, and said rungs being made of a polymeric material with a plurality of fibers reinforcing said polymeric material, each of said rungs including:

a horizontal portion extending laterally from said first stringer to said second stringer, said horizontal portion having a top surface and a bottom surface spaced from and opposite said top surface;

a vertical portion extending generally perpendicularly away from said bottom surface of said horizontal portion and extending laterally from said first stringer to said second stringer, said vertical portion having a front surface and a rear surface spaced from and opposite said front surface and said horizontal portion extending longitudinally beyond said front surface to form a front edge and said rear surface to form a rear edge such that said vertical portion is spaced longitudinally between said front edge and said rear edge of said horizontal portion to form a "T" shaped cross-section; and a plurality of first and second set of triangular-shaped ribs spaced along and coupled between said horizontal and vertical portions of said rungs wherein said first set of ribs extend from said bottom surface and longitudinally from said front edge to said front surface of said vertical portion and said second set of ribs extend from said bottom surface and longitudinally from said rear edge to said rear surface of said vertical portion;

wherein said rungs are coupled between said closed inner lateral surface of said first and second stringers opposite from said channels defined by said first and second stringers.

2. A ladder as set forth in claim 1 where in said first and second stringers having a substantially C-shape cross-section defining said channel.

3. A ladder as set forth in claim 1 wherein said first set of ribs are generally perpendicular to said bottom surface of said horizontal portion and said second set of ribs are generally perpendicular to said bottom surface of said horizontal portion.

4. A ladder as set forth in claim 1 wherein said first set of ribs includes a first pair of ribs intersecting at a first point of intersection to define a substantially V-shape and said second set of ribs includes a second pair of ribs intersecting at a second point of intersection to define a substantially inverted V-shape.

5. A ladder as set forth in claim 4 wherein said second point of intersection is aligned horizontally with and spaced vertically from said first point of intersection of said first and second pair of ribs.

6. A ladder as set forth in claim 1 wherein said first and second stringers each individually terminate in a foot having a tapered configuration.

7. A ladder as set forth in claim 1 comprising a polymeric material.

8. A ladder as set forth in claim 7 wherein said polymeric material includes fibers for reinforcing said polymeric material in an amount of from 25% to 75% by weight based on a combined total weight of said polymeric material and said fibers.

9. A ladder as set forth in claim 1 further including a support comprising:

a first rail and a second rail transversely spaced from said first rail;

a plurality of braces spaced along and coupled between said first and second rails; and a linkage pivotally coupling said ladder and said support.

10. A ladder as set forth in claim 9 wherein said linkage includes a pin and socket joint defining a void for receiving said pin.

11. An inverted "V"-shaped ladder comprising:

a first stringer and a second stringer spaced from each other, with each of said first and second stringers having a closed inner lateral surface and an open outer lateral surface forming a substantially C-shaped cross-section defining a channel;

a plurality of crosspieces disposed and extending longitudinally in said channels of said first and second stringers for rigidity;

a plurality of rungs spaced along and coupled between said first and second stringers with each of said rungs including:

a horizontal portion extending laterally from said first stringer to said second stringer, said horizontal portion having a top surface and a bottom surface spaced from and opposite said top surface;

a vertical portion extending generally perpendicularly away from said bottom surface of said horizontal portion and extending laterally from said first stringer to said second stringer, said vertical portion having a front surface and a rear surface spaced from and opposite said front surface and said horizontal portion extending longitudinally beyond said front surface to form a front edge and said rear surface to form a rear edge such that said vertical portion is spaced longitudinally between said front edge and said rear edge of said horizontal portion to form a "T" shaped cross-section; and a plurality of first and second set of triangular-shaped ribs spaced along and coupled between said horizontal and vertical portions of said rungs wherein said first set of ribs extend from said bottom surface and longitudinally from said front edge to said front surface of said vertical portion and said second set of ribs extend from said bottom surface and longitudinally from said rear edge to said rear surface of said vertical portion;

wherein said rungs are coupled between said closed inner lateral surface of said first and second stringers opposite from said channels defined by said first and second stringers.

* * * * *